United States Patent [19]

Negishi

[11] Patent Number: 5,067,390

[45] Date of Patent: Nov. 26, 1991

[54] DOUBLE-ACTING FLEXIBLE WALL ACTUATOR

[75] Inventor: Koichi Negishi, Kodaira, Japan

[73] Assignee: Bridgestone Corporation, Tokyo, Japan

[21] Appl. No.: 550,929

[22] Filed: Jul. 11, 1990

[30] Foreign Application Priority Data

Jul. 11, 1989 [JP] Japan ..... 1-177073

[51] Int. Cl.[5] ..... F01B 19/00

[52] U.S. Cl. ..... 92/48; 92/50; 92/61; 92/66; 92/92; 92/117 R; 92/151; 92/165 R

[58] Field of Search ..... 92/48, 50, 69, 75, 61, 92/62, 66, 92, 91, 117 R, 142, 151, 152, 165 R, 89, 90, 91; 417/478, 394

[56] References Cited

U.S. PATENT DOCUMENTS

| | | | |
|---|---|---|---|
| 3,481,254 | 12/1969 | Wetherbee, Jr. | 92/92 |
| 4,008,008 | 2/1977 | Vergnet | 92/92 |
| 4,076,467 | 2/1978 | Persson | 417/478 |
| 4,111,613 | 9/1978 | Sperry | 417/394 |
| 4,130,205 | 12/1978 | Luthi | 92/165 R |
| 4,792,173 | 12/1988 | Wilson | 92/92 |
| 4,860,639 | 8/1989 | Sakaguchi | 92/92 |

FOREIGN PATENT DOCUMENTS

| | | | |
|---|---|---|---|
| 0172795 | 2/1986 | European Pat. Off. | 417/394 |
| 2701843 | 7/1978 | Fed. Rep. of Germany | 92/90 |
| 951885 | 11/1949 | France | 92/48 |

*Primary Examiner*—Edward K. Look
*Assistant Examiner*—Thomas Denion
*Attorney, Agent, or Firm*—Sughrue, Mion, Zinn, Macpeak & Seas

[57] ABSTRACT

A double-acting actuator includes a first tubular body made of an elastic material, a first reinforcing braided structure surrounding the first tubular body, a second tubular body made of an elastic material surrounding the first reinforcing braided structure to form a space outwardly thereof, and a second reinforcing braided structure surrounding the second tubular body. The actuator further includes closure members for closing and joining ends of the first and second tubular bodies and reinforcing braided structures, and guiding device for permitting axial movements of the first and second tubular bodies but restraining lateral movements thereof. The first and second reinforcing braided structures are so constructed that initial braided angles thereof permit of the first braided structure elongating and permit of the second braided structure contracting when the pressurized fluid is supplied into the first and second tubular bodies.

8 Claims, 3 Drawing Sheets

DOUBLE-ACTING FLEXIBLE WALL ACTUATOR

BACKGROUND OF THE INVENTION

This invention relates to an actuator of an air-bag type extensible and contractible in axial directions by supplying and exhausting a pressurized fluid.

There has been known an actuator, for example, as shown in FIG. 1 as an air-bag type actuator capable of converting energy of a pressurized fluid into kinetic energy with high efficiency.

This actuator 10 includes a tubular body 12, a reinforcing braided structure 14 externally arranged thereon, and closure members 16 closing both ends of the tubular body 12 and the reinforcing braided structure 14. When a pressurized fluid is supplied into an internal space 20 of the tubular body 12 through a connecting aperture 18 formed in at least one of the closure members 16, an enlargement of initial braided angles $\theta$ of the reinforcing braided structure 14 or a pantograph movement of the braided structure 14 causes an expansion of a diameter of the tubular body 12 and a contraction of the body 12 in axial directions owing thereto or a contraction of a distance between both the closure members 16. Such an actuator has various advantages in that it is very light weight because of the construction above described and compliance as an actuator can be suitably changed by adjusting pressure of the pressurized fluid to be supplied.

In general, the tubular body 12 is preferably made of a rubber or rubber-like elastic material or a material equivalent thereto in consideration of impermeability to pressurized fluids and sufficient flexibility. The reinforcing braided structure 14 is preferably made of organic or inorganic high tension fibers having braided structures whose braided angles vary from initial braided angles, for example, 10° to 25° to so-called "angle of repose" (54°44′) when the tubular body expands at a maximum diameter.

With such an actuator, when the pressurized fluid is exhausted from the internal space 20, the actuator can return to its original shape with the aid of an elastic returning force of the tubular body 12. However, as the returning force is not sufficient, it is necessary to provide an elastic member such as a compression spring assisting in returning of the actuator to its original shape.

However, as the elastic member such as a compression spring has an invariable spring constant and a constant outer diameter, it will encounter a difficulty when it is required to change the compliance of the actuator including the elastic member and its outer shape and size. In this case, it is again needed to design and manufacture a spring member whose spring constant and outer diameter and outer size need respective requirements.

SUMMARY OF THE INVENTION

It is an object of the invention to provide an improved actuator which eliminates all the disadvantages of the prior art and is able to change the compliance of the actuator freely without requiring any elastic member such as a compression spring.

In order to accomplish this object, a double-acting actuator according to the invention comprises a first tubular body made of an elastic material, a first reinforcing braided structure surrounding the first tubular body, a second tubular body made of an elastic material surrounding the first reinforcing braided structure to form a space outwardly thereof, a second reinforcing braided structure surrounding the second tubular body, closure members for closing and joining ends of the first and second tubular bodies and reinforcing braided structures, and guide means for permitting axial movements of the first and second tubular bodies but restraining lateral movements thereof, said first reinforcing braided structure having initial braided angles permitting elongation movements of the first tubular body in axial directions on being supplied with a pressurized fluid thereinto and said second reinforcing braided structure having initial braided angles permitting contracting movements of the second tubular body in axial directions on being supplied with the pressurized fluid thereinto, thereby enabling the actuator to do reciprocative movements by supplying and exhausting the pressurized fluid into and from the respective tubular bodies.

The first tubular body and the first reinforcing braided structure are closed at both opening ends by means of the closure members. As initial braided angles of the braided structure are within 65° to 85°, when the pressurized fluid is supplied into the first tubular body, it slightly contracts radially inwardly, but extends radially inwardly.

On the other hand, the second tubular body and the second reinforcing braided structure are closed at both opening ends by the closure members. As initial braided angles of the braided structure are within 10° to 25°, when the pressurized fluid is supplied into the second tubular body, it expands radially outwardly, but contracts in the axial directions.

Therefore, by suitably adjusting the supply and exhaust of the pressurized fluid into and from the first and second tubular bodies, their extending and contracting forces are increased or reduced, thereby causing requisite movements of the actuator.

Moreover, the guide means arranged in the tubular body permit the respective tubular bodies to move in parallel with their axes, but restrains lateral movements of the tubular bodies, thereby constantly enabling moving directions of the actuator to be coincident with requisite directions.

The invention will be more fully understood by referring to the following detailed specification and claims taken in connection with the appended drawings.

DETAILED EXPLANATION OF THE PREFERRED EMBODIMENTS

Figure 1:
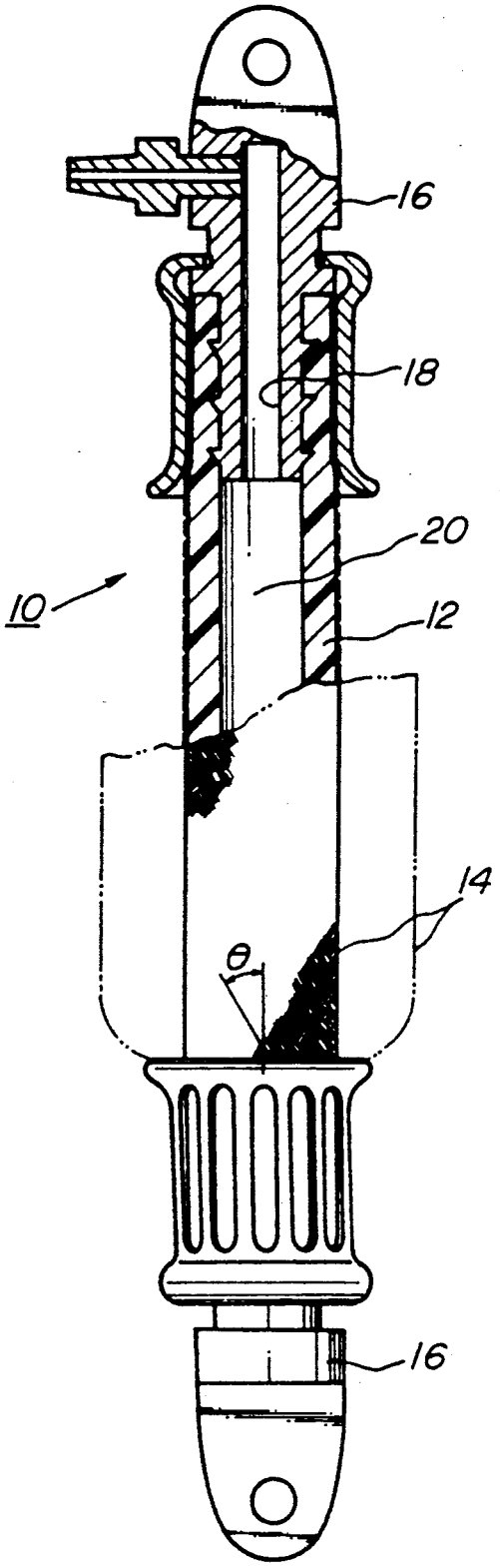
FIG 1 PRIOR ART
FIG. 1 is an explanatory view illustrating an actuator of the air-bag type of the prior art.
Figure 2:
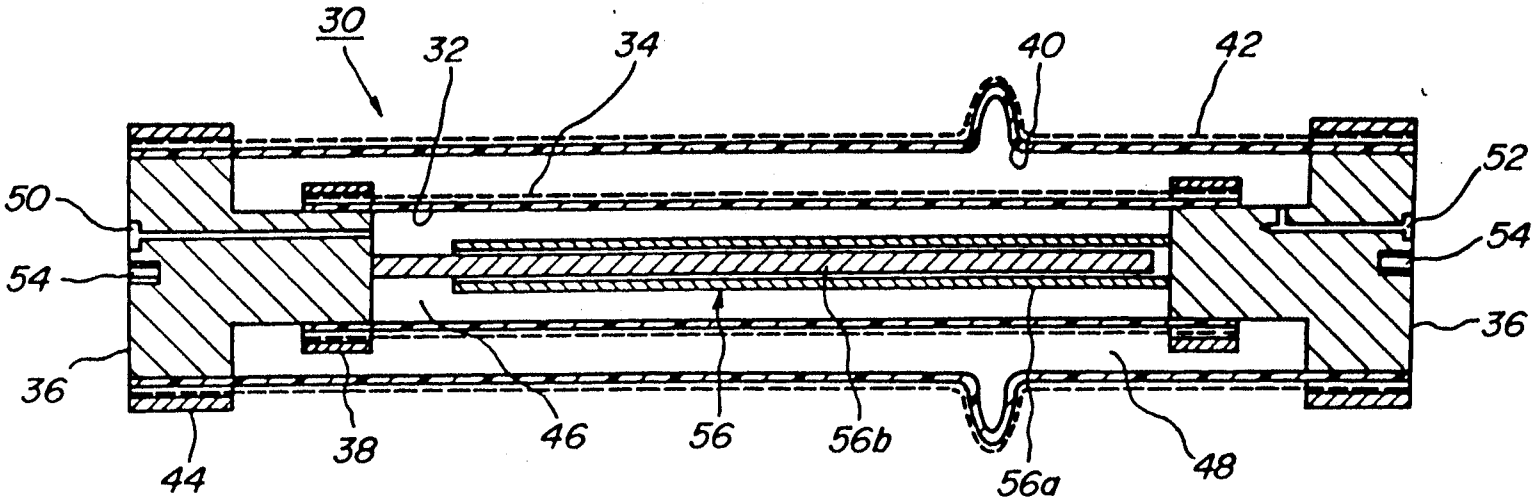
FIG. 2 is an explanatory view illustrating in section a double-acting actuator according to the invention.

FIG. 2 illustrates in section an actuator 30 as one embodiment of the invention. The actuator 30 includes a first tubular body 32 made of a rubber or a rubber-like elastic material, and a first reinforcing braided structure 34 provided on an outer circumference of the first tubular body 32. The first reinforcing braided structure is reinforced by cords which are organic or inorganic high tension fibers, for example, twisted or nontwisted filament bundles of aromatic polyamide fibers or very fine metal wires. Openings at both ends of the tubular body and the reinforcing braided structure are closed by closure members 36. Both the ends of the tubular body 32 and the braided structure 34 are clamped outwardly by first clamp sleeves 38 to prevent the tubular body 32 and the braided structure 34 from being dislodged from the closure members 36.

A second tubular body 40 made of a material equivalent to that of the first tubular body 32 is arranged so as to surround the first reinforcing braided structure 34 form a space radially outwardly of the first reinforcing braided structure 34. Second reinforcing braided structure 42 is arranged on an outer circumference of the second tubular body 40. Openings at both ends of the tubular body and the reinforcing braided structure are closed by closure members 36. Both the ends of the tubular body and the reinforcing braided structure are clamped outwardly by the second clamp sleeves 44 to prevent the second tubular body 40 and the second braided structure 42 from being dislodged from the closure members 36.

Each of the closure members 36 closing both the openings at the ends of the first and second tubular bodies and braided structures is constructed by two coaxial circular column members integrally connected whose outer diameters are substantially equal to inner diameters of the first and second tubular bodies 32 and 40 in this embodiment. However, it is not limited to this configuration. For example, the closure member 36 may be formed by separable members. In order to make easy mounting the actuator, the closure member 36 is preferably formed at end with internal threads 54 in its axial direction.

Moreover, each of the closure members 36 is formed with a connecting aperture 50 communicating with an inner space 46 in the first tubular body 32 or a connecting aperture 52 communicating with an inner space 48 in the second tubular body 40. These connecting apertures serve to supply and exhaust a pressurized fluid into and from the inner spaces in these tubular bodies. Further, each of the closure members is formed at an opening of the connecting aperture 50 or 52 with internal threads to facilitate connecting with a piping (not shown) for supply and exhaust of the pressurized fluid.

In the first tubular body 32 is provided guide means 56 which permits relative movements of the closure members 36 along axial directions of the tubular body, but restrains the closure members in lateral directions.

In this embodiment, the guide means 56 comprises a cylindrical member **56*a* extending in the axial direction of the tubular body 32, whose one end is fixed to one of the closure members 36, and a bar member slidably fitted in the cylindrical member 56*a*, whose one end is fixed to the other closure member 36**. However, the guide means may be constructed by a bar member having a groove extending in the axial direction and a member having at a free end a projection adapted to engage in the groove of the bar member.

Initial braided angles $\theta_1$ and $\theta_2$ of the first and second reinforcing braided structures 34 and 42 should be noticed in this case.

Figure 3:
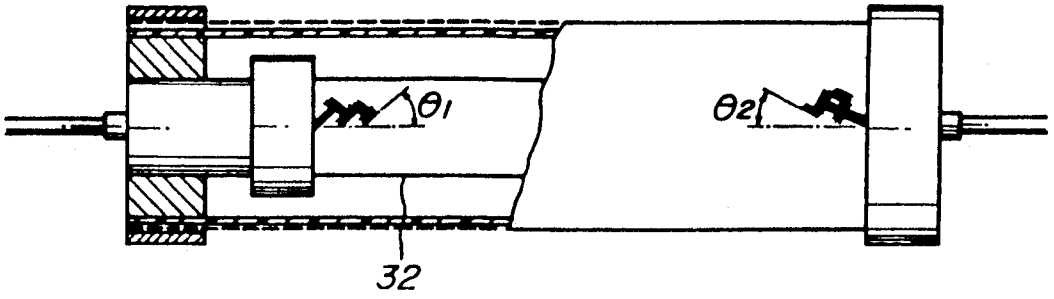
FIG. 3 is an explanatory view illustrating braided angles of reinforcing braided structures of the actuator shown in FIG. 2.

As shown in FIG. 3, the initial braided angle $\theta_1$ of the first reinforcing braided structure 34 is so determined that when the pressurized fluid is supplied into the first tubular body 32, the tubular body 32 is permitted to elongate in the axial directions and when at a maximum elongation, the braided angle becomes a so-called "angle of repose" (54°44'). The initial braided angle is preferably selected within a range of 65° to 85°.

On the other hand, the initial braided angle $\theta_2$ of the second reinforcing braided structure 42 is so determined that when the pressurized fluid is supplied into the second tubular body 42, the tubular body 42 is permitted to contract in the axial directions and when at a maximum contraction (minimum length), the braided angle becomes a so-called "angle of repose" (54°44'). The initial braided angle is preferably selected within a range of 10° to 25°.

When the initial braided angles of the first and second reinforcing braided structures 34 and 42 are selected as above described, the first and second tubular bodies and braided structures are moved in the following manner. Namely, when the pressurized fluid is supplied, the first tubular body 32 and reinforcing braided structure 34 closed at the ends by the closure members 36 slightly contract radially inwardly, but axially elongate, while the second tubular body 40 and reinforcing braided structure 42 closed at the ends by the closure members 36 expand radially outwardly, but axially contract.

However, as the closure members 36 closing both the ends of the first and second tubular bodies and braided structures are commonly used, respectively, a distance between both the closure members or a stroke of the actuator can be freely changed by suitably adjusting the pressure to be applied into the inner spaces of the first and second tubular bodies.

Moreover, when the pressurized fluid is applied into the tubular bodies, the first tubular body 32 positioned inwardly contracts radially inwardly, whereas the second tubular body 40 positioned outwardly expands radially outwardly. Therefore, the respective movements including movements of the reinforcing braided structures associated therewith do not interfere with each other.

Moreover, when such an actuator is used, in an initial setting condition the tubular body 32 is previously elongated by applying an initial setting pressure in the inner space of the first tubular body 32 positioned inwardly. Therefore, respective natural lengths of the second tubular body 40 and the reinforcing braided structure 42 are determined so as to be substantially equal to an effective length of the first tubular body elongated owing to the application of the initial setting pressure. Therefore, the second tubular body 40 and the second reinforcing braided structure 42 include slacks or sags at midways before applying the pressurized fluid into the inner space 48 thereof.

The operation of the actuator will be explained hereinafter. It is assumed that the inner spaces of the tubular bodies 32 and 40 are communicated through the connecting apertures 50 and 52 connected with suitable operating pressure source including known valves for controlling the supply and exhaust of the pressurized fluid, for example, supply and exhaust pipings connected to an air compressor.

When the initial setting pressure is applied into the inner space 46 of the first tubular body through a supply and exhaust piping (not shown) connected to the connecting aperture 50, the first tubular body elongates in the axial directions as decreasing the initial braided angle $\theta_1$ of the first reinforcing braided structure 34, while the second tubular body 40 and braided structure 42 elongates in the axial directions.

Figure 4:
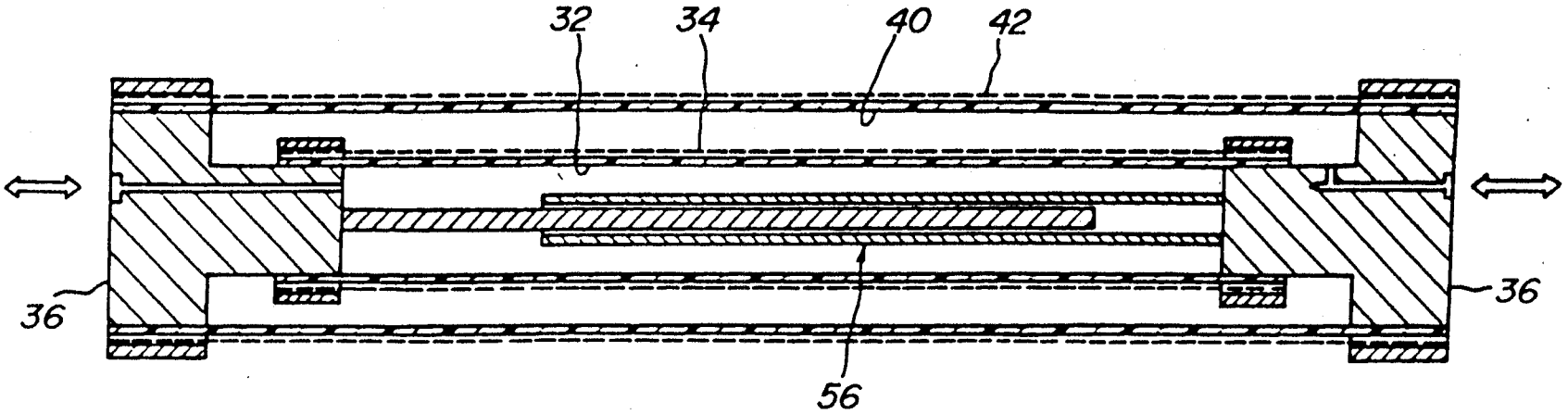
FIG. 4 is a sectional view illustrating an initial operating condition of the actuator shown in FIG. 2.

At this moment, the pressurized fluid is supplied into the inner space 48 of the second tubular body 40 through a supply and exhaust piping (not shown) connected to the connecting aperture 52, as increasing the initial braided angle $\theta_2$ of the second reinforcing braided structure 42, the second tubular body 40 expands radially outwardly to cause contracting forces in the tubular body 40 against the elongating forces of the first tubular body 32 so that the contracting force in the second tubular body 40 and the elongating force of the first tubular body 32 are balanced. This condition is shown in FIG. 4.

When the pressurized fluid is further supplied into the inner space 48 in the second tubular body, the contracting force of the second tubular body 40 overcomes the elongating force of the first tubular body 32 so that the distance between the closure members 36 is shortened.

In this case, the pressurized fluid is exhausted from the inner space 46 of the first tubular body 32 to reduce its elongating force in conjunction with the supply and exhaust of the pressurized fluid into and from the inner space 48 of the second tubular body 40. In this manner, the contracting force of the second tubular body can be converted into a kinetic energy with high efficiency, and at the same time the responsibility of the actuator can be improved.

On the other hand, when it is desired to return the actuator 30 to its initially set condition, it can be accomplished by exhausting the pressurized fluid from the inner space 48 in the second tubular body to reduce its contracting force. In this case, of course, the pressurized fluid may be supplied into the first tubular body 32, while the pressurized fluid may be exhausted from the second tubular body 40 for the same purpose. Moreover, if the pressure of the fluid to be supplied into the first and second tubular bodies is set relatively high, the compliance as the actuator can be set at a high value. On the other hand, if the pressure of the fluid to be supplied into the first and second tubular bodies is set relatively low, the compliance of the actuator can be set at a low value.

In either case, moreover, the guide means 56 provided in the first tubular body 32 restrains lateral movement of the first and second tubular bodies elongating upon being supplied with the pressurized fluid, so that the relative movement of the closure members 36 in the radial directions can be ensured.

The invention is not limited to these embodiments. The guide means may be provided with detecting means for detecting the relative movement between the closure members, for example, differential transformer. The pressure of the fluid to be supplied into the respective tubular bodies may be controlled in response to signals from such a detecting means. Moreover, anchoring means may be provided for regulating the relative movements of the closure members. Various modifications and changes can be made within the scope of the invention.

As can be seen from the above explanation, the invention can provide a double-acting actuator of the air-bag type which is very light weight and is able to elongate and contract in axial directions and whose compliance can be suitably changed by the controlling supply and exhaust of the pressurized fluid into and from the respective tubular bodies.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A double-acting actuator comprising a first tubular body made of an elastic material, a first reinforcing braided structure surrounding the first tubular body, a second tubular body made of an elastic material surrounding the first reinforcing braided structure to form a space outwardly thereof, a second reinforcing braided structure surrounding the second tubular body, closure members for closing and joining ends of the first and second tubular bodies and reinforcing braided structures, and guide means for permitting axial movements of the first and second tubular bodies but restraining lateral movements thereof, said first reinforcing braided structure having initial braided angles permitting elongation movements of the first tubular body in axial directions on being supplied with a pressurized fluid thereinto and said second reinforcing braided structure having initial braided angles permitting contracting movements of the second tubular body in axial directions on being supplied with the pressurized fluid thereinto, thereby enabling the actuator to do reciprocative movements by supplying and exhausting the pressurized fluid into and from the respective tubular bodies.

2. A double-acting actuator as set forth in claim 1, wherein each of the closure members comprises two coaxial circular column members formed integrally whose outer diameters are substantially equal to inner diameters of the first and second tubular bodies and ends of the first and second tubular bodies on the closure member are clamped by a clamp sleeve.

3. A double-acting actuator as set forth in claim 1, wherein each of the closure members is formed at an end with internal threads in its axial direction to facilitate mounting of the actuator.

4. A double-acting actuator as set forth in claim 1, wherein one of the closure members is formed with a connecting aperture communicating with in an inner space in the first tubular body and the other closure member is formed with a connecting aperture communicating with an inner space in the second tubular body.

5. A double-acting actuator as set forth in claim 1, wherein said guide means comprises a cylindrical member extending in the axial direction of the first tubular body, whose one end is fixed to one of the closure members, and a bar member slidably fitted in the cylindrical member, whose one end is fixed to the other closure member.

6. A double-acting actuator as set forth in claim 1, wherein initial braided angles of the first reinforcing braided structure is determined so that when the pressurized fluid is supplied into the first tubular body, the tubular body is permitted to elongate in the axial directions and when at a maximum elongation the braided angle becomes an angle of repose (54°44').

7. A double-acting actuator as set forth in claim 1, wherein initial braided angles of the second reinforcing braided structure is determined so that when the pressurized fluid is supplied into the second tubular body, the tubular body is permitted to contract in the axial directions and when at a maximum contraction the braided angle becomes an angle of repose (54°44').

8. A double-acting actuator as set forth in claim 1, wherein the second tubular body and the second reinforcing braided structure include sags at midways before applying the pressurized fluid into inner spaces of the first and second tubular bodies.

* * * * *